United States Patent [19]

L'Hermite et al.

[11] 4,035,203

[45] July 12, 1977

[54] METHOD FOR THE HEAT-TREATMENT OF STEEL AND FOR THE CONTROL OF SAID TREATMENT

[75] Inventors: Mathurin L'Hermite, Versailles; Raymond Le Bossenec, Fontenay-le-Fleury; Pierre Godart, Plaisir; Francois Pierrard, Versailles, all of France

[73] Assignee: L'Air Liquide, Societe Anonyme pour l'Etude et l'Exploitation des Procedes Georges Claude, Paris, France

[21] Appl. No.: 534,301

[22] Filed: Dec. 19, 1974

[30] Foreign Application Priority Data

Dec. 21, 1973 France ..... 73.45946
Oct. 21, 1974 France ..... 74.35315

[51] Int. Cl.[2] ..... C21D 1/48

[52] U.S. Cl. ..... 148/16.5; 148/16.6; 148/20.3

[58] Field of Search ..... 148/16.5, 16, 16.6, 148/20.3; 266/5

[56] References Cited

U.S. PATENT DOCUMENTS

| | | | |
|---|---|---|---|
| 3,058,815 | 10/1962 | Davis | 148/16.5 |
| 3,356,541 | 12/1967 | Cullen | 148/16.5 |
| 3,413,161 | 11/1968 | Goehring | 148/16.5 |
| 3,693,409 | 9/1972 | Yamagishi | 148/16.5 |
| 3,705,058 | 12/1972 | Kolozsyari et al. | 148/16.6 |
| 3,748,195 | 7/1973 | Kondo et al. | 148/16.5 |
| 3,790,413 | 2/1974 | Kanetake | 148/16.5 |
| 3,870,572 | 3/1975 | Brugger et al. | 148/16.5 |

FOREIGN PATENT DOCUMENTS

| | | | |
|---|---|---|---|
| 1,578,942 | 8/1969 | France | 148/16.5 |
| 1,156,180 | 6/1969 | United Kingdom | 148/16.5 |

*Primary Examiner*—Walter R. Satterfield
*Attorney, Agent, or Firm*—Curtis, Morris & Safford

[57] ABSTRACT

The invention relates to a method of and an installation for the heat treatment of steels, such as heating before hardening, annealing, carburization and carbo-nitridation, carried out in a furnace in the presence of a protection or carbon-enrichment atmosphere which flows continuously through the furnace, the atmosphere being obtained by the mixture, before its introduction into the furnace, of a carrier gas including nitrogen and possibly hydrogen, and an active gas constituted by a hydrocarbon, the mixture containing at least 0.2% by volume of hydrocarbon.

The active gas may be constituted by ethylene, ethane or acetylene and the treatment is carried out at a temperature between 700° and 1050° C.

The installation includes a device for analyzing the atmosphere at the furnace outlet, this analyzer actuating a regulating valve for the inlet flow of active gas through a servo-mechanism, in dependence on the proportion of carbon in the treated steel.

4 Claims, 2 Drawing Figures

METHOD FOR THE HEAT-TREATMENT OF STEEL AND FOR THE CONTROL OF SAID TREATMENT

The present invention essentially relates to a method of heat treatment of steel, such as heating before hardening, annealing, carburization, carried out in a furnace in the presence of a protection or carbon-enrichment atmosphere, the said atmosphere flowing continuously in the furnace and being obtained by mixture, prior to its introduction into the furnace, of a carrier gas including hydrogen and possibly nitrogen, and an active gas constituted by a hydrocarbon, the mixture containing at least 0.2% by volume of hydrocarbon.

It is known that the use of such protecting or enrichment atmospheres, known as controlled atmospheres, for the heat treatment of steels makes it possible:

either to maintain the surface condition of the metal;

or to modify the surface composition of the metal, generally by the addition of certain consituents, in particular carbon, in the case of carburization or case-hardening by carbon.

According to the method of treatment described in French Pat. No. 1,578,942, there is essentially employed as the protection or carburization atmosphere, a mixture of nitrogen and propane. Tests made within the framework of this known method have shown that the nitrogen could contain substantial quantites of hydrogen and the propane could be replaced by natural gas or another hydrocarbon.

However, these tests did not form the object of complete and exhaustive studies tending to determine the proportions to be observed of the constituents of the carrier gas of the atmosphere or the specific nature of the hydrocarbons which can constitute the active gas of the said atmosphere and the carrying into practice of this known method cause certain difficulties to appear, in particular the existence on the treated parts of deposits of soot adversely affecting the quality of the finished product.

Another difficulty of this known method is the impossibility of controlling and mastering the carburant activity (or carbon potential) of the atmosphere with sufficient accuracy. In fact, this method puts the carburant activity into practice in a purely empirical manner, so that the production of a case-hardened steel or predetermined characteristics or the achievement of a total absence of de-carburization remain very risky and result from a more or less long series of trial and error operations.

There is also known a method of carburization of steels at 1,000° C., which consists of putting the parts to be treated into a chamber under vacuum, and then introducing natural gas at a controlled pressure into the said chamber. This method has the disadvantage of necessitating complicated and costly installations.

The present invention has for its object to overcome the above-mentioned drawbacks of the known methods, especially by deepening and widening the study of the method already known from the above-mentioned patent.

This object is attained according to the method of the invention, essentially by the fact that the above-mentioned protection or enrichment atmosphere is obtained by the mixture of the above-mentioned carrier gas with a hydrocarbon chosen from one of the following compounds: $C_2H_4$, $C_2H_6$, $C_2H_2$, the proportion by volume of hydrocarbon possibly reaching 30%, and that the steel to be treated is brought up to a temperature between 700° and 1050° C.

Experience has in fact shown that the utilization of these specifically chosen hydrocarbons under the conditions of temperature indicated, makes it possible to reduce considerably the deposits of soot, these latter being even eliminated at temperatures higher than 950° C., and to effect the carburization at temperatures in the neighborhood of 1,000° C., and without having recourse to vacuum techniques.

According to another characteristic feature of the invention, in the case where the carrier gas comprises a mixture of nitrogen and hydrogen, the hydrogen may reach 30% by volume of the said mixture.

According to still another characteristic feature of the invention, the carrier gas may further comprise 0 to 2% by volume of $CO_2$.

The method according to the invention is also applicable to the production of another type of case-hardening, which includes incorporating in the steel, in addition to the carbon derived from the decomposition of the hydrocarbons, the nitrogen obtained from the decomposition of ammonia, thus obtaining carbo-nitridation.

This object is achieved by the fact that the above-mentioned atmosphere is obtained by mixture of the said carrier gas with a hydrocarbon chosen from one of the following compounds: $C_2H_4$, $C_2H_2$, $C_2H_6$, $C_3H_8$, $CH_4$, and ammonia, the proportion of ammonia in the total mixture being between 0.1 and 30% by volume, and the temperature of the steel being between 650° and 950° C.

There is thus obtained, after hardening, a steel having a surface hardness greater than that of a steel which has been subjected to a simple carburization.

In addition, the speed of diffusion in the steel of the carbon derived from the decomposition of the hydrocarbon and of the nitrogen obtained from the decomposition of the ammonia being substantially higher than that of the carbon alone, the method is thus more rapid than the method of carburization alone.

According to another characteristic feature of the invention, the steel is brought to a temperature of between 800° and 900° C.

This range constitutes the usual range of carbonitridation.

The invention also refers to a method of control of the heat treatment of steel, carried out in a furnace in the presence of an atmosphere obtained by the mixture of a carrier gas and an active gas constituted by a hydrocarbon.

This method of control is characterized by the fact that the residual content of hydrocarbon in the atmosphere passing out of the furnace is measured, by the use of previously prepared graphs which give a relation between the residual contents and the quantities of carbon introduced into the steel, the quantity of hydrocarbon of the atmosphere passing into the furnace which is necessary to obtain the quantity of carbon desired is determined, and the proportion of hydrocarbon in the said atmosphere passing into the furnace is regulated so as to obtain the said content at the outlet of the furnace.

The treatment may therefore, by virtue of this control, be effected in a systematic manner so as to obtain a final product having the desired characteristics, avoiding the trial and error and hazardous methods previously known.

The invention also covers the steels obtained by the above-mentioned method.

Other characteristic features and advantages of the invention will become apparent during the course of the description which follows below, reference being made to the accompanying drawings, given by way of non-restrictive example, and in which.

Figure 1:
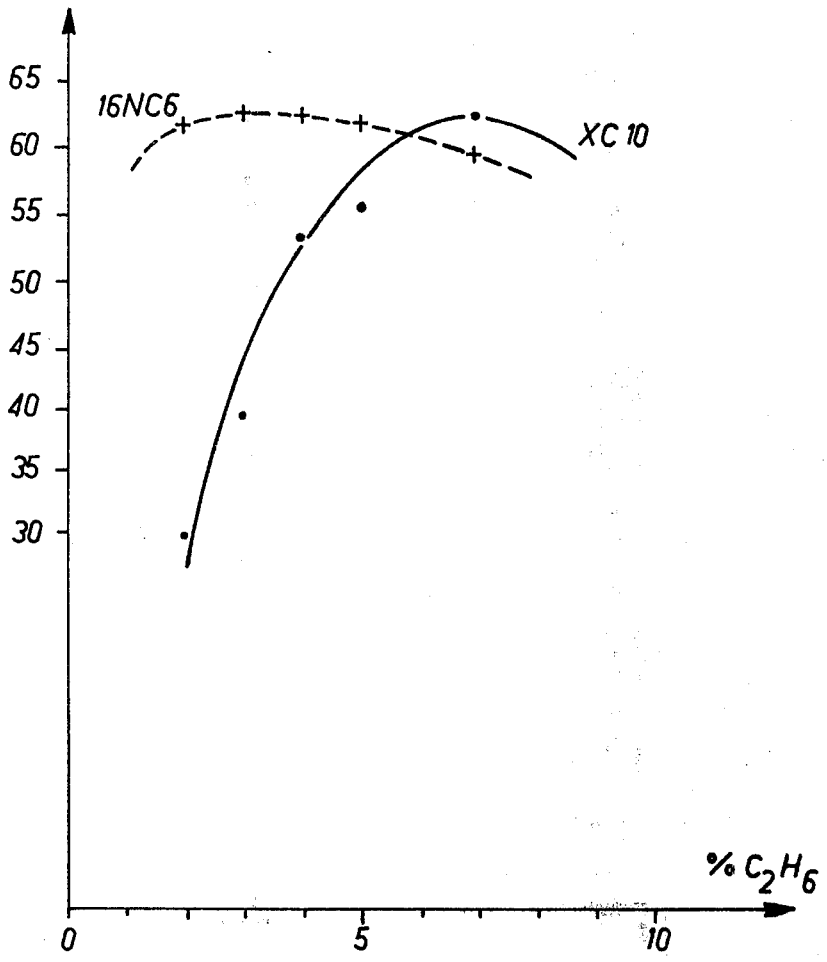
FIG. 1 shows the hardness curves of steels treated according to the method of the invention.

The controlled atmospheres for the heat treatment of steels are essentially directed either to prevent oxidation and surface decarburization during heating before hardening or annealing, or to incorporate in the steels a certain quantity of carbon while at the same time also preventing oxidation, which results in the use of mixtures comprising gases inactive with respect to the steel at the treatment temperatures, such as nitrogen, and active gases capable of yielding carbon directly. These controlled atmospheres are introduced at a constant flow-rate into a treatment chamber, for example the hearth of an annealing or case-hardening furnace.

Tests carried out on carrier or diluent gases which up to the present time were constituted essentially either by nitrogen alone or by mixtures of nitrogen and hydrogen, the proportions of which were in no way defined with accuracy, have shown that in the case of nitrogen-hydrogen, these proportions could not be indefinite, and it was determined that the percentage by volume of hydrogen must be between 0 and 30%. The addition of hydrogen in the above-mentioned proportions to the nitrogen improves the surface condition of the steels treated, especially for treatment temperatures of between 950° and 1050° C.

Tests have also shown that it was possible advantageously to incorporate in carrier gases a small proportion of carbon dioxide. In particular, the addition of 0 to 2% by volume of $CO_2$ to the nitrogen enables the quality of the parts treated to be considerably improved, especially for treatment temperatures between 850° and 950° C.

Furthermore, tests carried out on the active gases have shown that the nature and the percentage of the hydrocarbons giving the best results, varied according to the treatment temperature, the nature of this treatment and the grade of steel to be treated.

Amongst the hydrocarbons which had been employed up to the present time, it has been decided to choose ethane $C_2H_6$, ethylene $C_2H_4$ and acetylene $C_2H_2$, the use of these hydrocarbons making it possible to reduce considerably or even to eliminate the deposits of soot on the treated parts.

As regards the preferred temperatures of treatment, it has proved that these temperatures, for practically all steels, could be located between 700° and 1050° C., and the proportion by volume may reach 30%. It was found that acetylene in a proportion by volume of between 0.2 and 12% gives particularly advantageous results between 880° and 920° C., and especially at 900° C.

The controlled atmospheres according to the invention have also made it possible to effect case-hardening with carbon at between 850° C. under the best conditions, that is to say practically without deposit of soot. Carburization of steel has been effected by utilizing $C_2H_6$ or $C_2H_4$ with a proportion by volume between 1 and 15% and a temperature of between 850° and 1050° C. The particular use of a mixture of nitrogen and ethylene with 8% by volume of ethylene enables operation at a temperature in the vicinity of 1000° C. The atmospheres according to the invention thus make it possible, by working at a high temperature, to reduce considerably the duration of the treatment without having recourse to vacuum techniques.

The above-mentioned atmospheres may also be employed, in addition to the case of cementation by systematic case-hardening with carbon, whenever any decarburization is to be feared, especially in the general case of annealing, and in particular of globulization annealing of steels and heating before hardening.

Various tests have also been made by adding to the atmospheres formed by mixtures of carrier gas and active gas of the type described above, adequate quantities of ammonia.

These tests were carried out in particular by using hydrocarbons such as ethane, $C_2H_6$, ethylene $C_2H_4$ and acetylene $C_2H_2$ with a proportion of hydrocarbon in the mixture of carrier gas and active gas which may reach 30% by volume, as indicated above.

Tests have also been carried out by utilizing, instead of the above-mentioned hydrocarbons, propane $C_3H_8$ or natural gas, mainly with $CH_4$, the proportion of these hydrocarbons possibly reaching 30%, as in the previous case.

As regards the preferred treatment temperatures, it has proved that, for practically all steels, these temperatures could be between 650° C., or a range included between two extreme temperatures which are slightly lower than those of the carburization treatments previously referred to (750°–1050° C.). This reduction in temperature is due to the presence of ammonia. However, the usual temperatures are included in a more restricted range of 800° to 900° C.

The quantity of ammonia to be added to the carburization atmosphere in order to obtain a carbonitridation atmosphere depends essentially on the temperature of the treatment, and this quantity can vary between 0.1 and 30% by volume of the total volume.

The control and operation of the carbo-nitriding activity of the controlled atmospheres can be effected, as in the case of the carburizing activity, by analysis of the atmosphere passing out of the furnace; in particular by the measurement of the residual quantities of $CH_4$ and/or of $C_2H_4$. In this case, the addition of hydrocarbon and the addition of ammonia are regulated in dependence on the analysis of the atmosphere passing out of the furnace, and on the result desired.

There will be given below two examples of application of the method of carbo-nitridation of steels.

EXAMPLE 1

Parts of XC 10F (AFNOR Standard) steel were subjected to a carbo-nitridation treatment for 4 hours at 850° C. in a furnace of small size of the tubular type, unstirred, by means of an atmosphere having the following average composition by volume:

$N_2$ . . . 97%
$C_2H_6$ . . . 1%
$NH_3$ . . . 2%.

The content of $CH_4$ at the outlet of the furnace was maintained at 0.4%.

The hardness of the carbonitrided and then oil-hardened layer was 83 Rockwell in the scale A.

The carbo-nitrided depth reached 0.40 mm.

EXAMPLE 2

Parts of 20 CD 2 steel were carbo-nitrided at 880° C. for 9 hours in an industrial furnace of the batch type with built-in hardening tank. The atmosphere utilized had the following average composition by volume:

$N_2$ . . . 95.0%
$C_2H_4$ . . . 1.7%
$NH_3$ . . . 3.3%.

The content of $CH_4$ at the outlet of the furnace was maintained at 0.1%.

Hardness measurements carried out on parts oil-hardened after this treatment gave the values of 61 Rockwell in the scale C.

The carbo-nitrided depth reached 0.90 mm.

In order to be able to check and control the carburizing activity or carbon potential of the controlled atmospheres with sufficient accuracy, and so as to obtain in consequence a fixed product having definite characteristics, it is desirable to measure accurately the percentage of hydrocarbons contained in the atmosphere passing out of the treatment chamber, and therefore to control the addition of hydrocarbons to the carrier gas at the inlet of the treatment chamber.

This control is effected according to the invention as a function of the residual composition of the atmosphere passing out of the furnace. It has in fact been found that the analysis of the atmosphere passing out of the furnace makes it possible to follow its carburizing activity or carbon potential. Graphs were therefore prepared which give a relation between the residual content of hydrocarbon, for example of $C_2H_4$, at the outlet of the furnace and the carbon introduced into the steel.

The utilization of these graphs makes it possible to regulate the carbon potential by regulating the addition of the hydrocarbon to the atmosphere admitted to the inlet of the furnace, as a function of the residual content of this hydrocarbon in the atmosphere passing out of the furnace. This measurement of the residual content of hydrocarbon can be effected by conventional methods: chromatography, spectrometry, etc. Action may be made directly on the flowrate of the hydrocarbon as a function of the measured value of the residual content.

There will be given below an example of application of the method of treatment according to the invention and of the control of this method.

Steel parts of grades XC 10 and case-hardening steel of grades 16 NC 6 (AFNOR Standard) were carburized for 4 hours at 900° C. in a furnace of the "well" type provided with stirring means, by means of an atmosphere constituted by a mixture of $N_2 + C_2H_6$.

Measurements of the Rockwell hardness made on parts oil-hardened after carburization enables the plotting of the hardness of the steel in the form of curves as a function of the percentage of $C_2H_6$. These curves, which then can be used as standards to determine hardness, shown by a solid line in FIG. 1 for the XC 10 steel and by a broken line for the 16 N 6 steel, illustrate that maximum hardness (62.5 Rockwell C) is obtained for variable contents of $C_2H_6$ according to the grade of the steel;

- 3 to 4% by volume of $C_2H_6$ for 16 NC 6;
- 7% by volume of $C_2H_6$ for XC 10.

At the outlet of the furnace, the residual hydrocarbon content is 0.5% for 16 NC 6 and 2.3% for XC 10.

Measurement made on these treated parts showed that the depths carburized followed the laws of diffusion in the same manner as in the case of previous methods.

Figure 2:
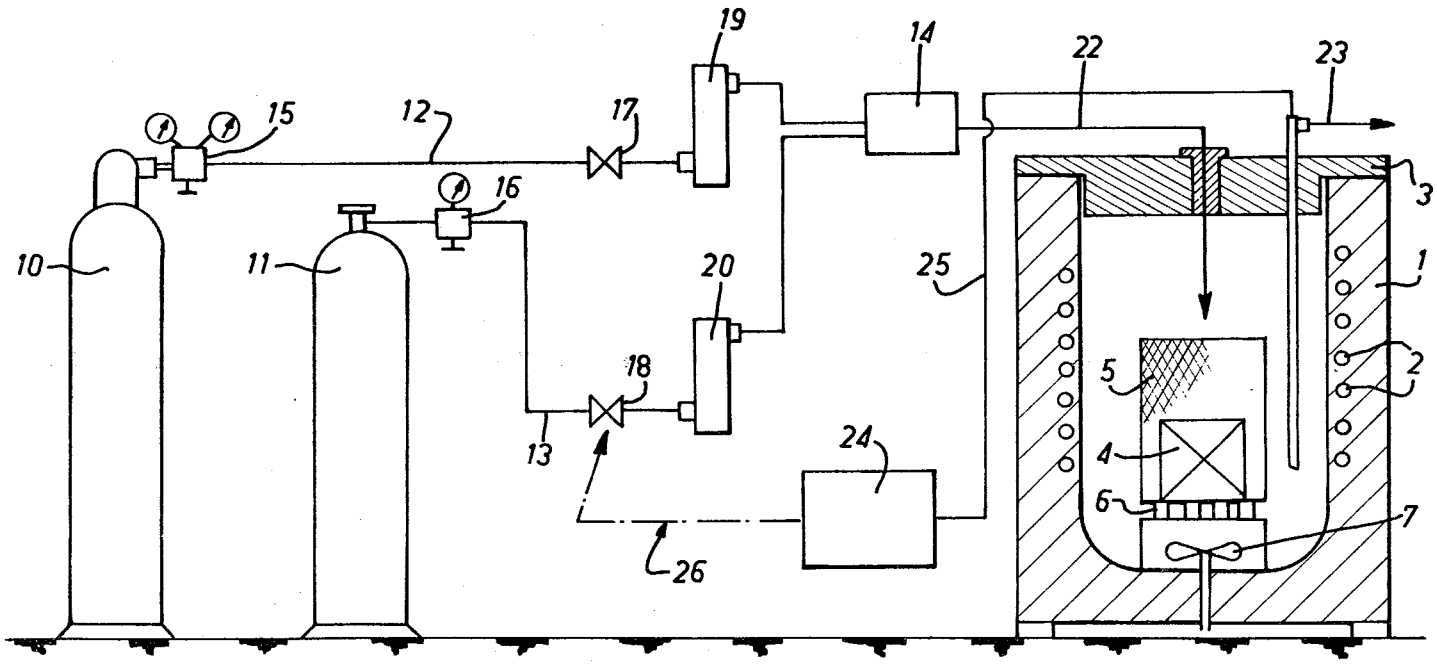
FIG. 2 shows diagrammatically an installation for carrying into effect the method according to the invention, with control and operations of the conditions of treatment.

There has also been shown in a diagrammatic manner, in FIG. 2, a controlled heat-treatment installation according to the invention, which comprises essentially a furnace 1 of the "well" type of refractory material lined internally with a jacketing of steel, provided with heating resistances 2 and closed by a cover 3.

The steel part to be treated, shown in the form of a block 4, is placed inside the furnace in a basket 5 or the like which rests on a grid 6 below which is located a rotary agitator 7, the function of which is to stir continuously the furnace atmosphere.

Two receptacles 10 and 11, receptacle 10 containing the carrier gas and the receptacle 11 the active gas (these gases being stored in gaseous or liquid form) supply a mixer 14 through the intermediary of conduits 12 and 13 respectively. On each conduit 12 and 13 are provided a pressure-reducing valve 15 and 16 respectively, a valve 17 and 18 respectively, and a flow-meter 19 and 20 respectively. The mixer 14 supplies a controlled atmosphere continuously to the furnace through a conduit 22, this atmosphere being evacuated from the said furnace through a conduit 23, also in a continuous manner.

The installation further comprises a gas analyzer 24 connected through a conduit 25 to the evacuation conduit 23. With this analyzer is incorporated a servomechanism shown diagrammatically at 26, which is controlled in dependence on the residual content of hydrocarbon, measured by the analyzer, such as against a predetermined or reference hydrocarbon content level, and which actuates the valve 18 in such manner as to vary the flow-rate of the hydrocarbon and therefore the proportion of this hydrocarbon in the mixture admitted to the furnace.

There is thus obtained an automatic regulation of the carbon potential of the atmosphere, which makes it possible, in the example of case-hardening, to obtain a steel having definite characteristics, and in the case of annealing heating or heating before hardening, to maintain the steel in its initial conditions, that is to say to prevent any surface carburization or de-carburization.

What we claim is:

1. A method of heat treatment of steel comprising the steps of mixing a nitrogen-containing carrier gas, ammonia and an active gas including a hydrocarbon selected from the group consisting of the compounds $C_2H_4$, $C_2H_2$, $C_2H_6$, $C_3H_8$ and $CH_4$, the mixture containing 0.1 to 30% by volume of ammonia, less than 30% by volume of hydrogen and between 0.2 to 30% by volume of hydrocarbon, continuously introducing the thus formed mixture into a furnace containing the steel to be heat-treated, to provide an atmosphere consisting substantially entirely of said mixture around the steel, heating the steel and the surrounding atmosphere to a temperature within the range of from 650° to 950° C, continuously withdrawing the atmosphere from said furnace, measuring the residual content of hydrocarbon in the atmosphere withdrawn from said furnace, comparing the thus measured residual hydrocarbon content with a predetermined hydrocarbon content level to thereby ascertain the hardness of the steel, and regulating the flow rate of hydrocarbon in the atmosphere introduced into the furnace as a function of said comparison to provide a residual hydrocarbon content corresponding to the desired hardness of the steel.

2. A method as claimed in claim 1, in which the steel is heated to a temperature of between 800° and 900° C.

3. A method as claimed in claim 2, in which, for an XC 10 steel, said controlled atmosphere is constituted by a mixture containing the following compounds in the specified proportions by volume:

$N_2$. . . 97%
$C_2H_6$. . . 1%
$NH_3$. . . 2%.

4. A method as claimed in claim 2, in which, for a 20 CD 2 steel, said controlled atmosphere is constituted by the compounds in the specified following proportions by volume:

$N_2$. . . 95.0%
$C_2H_4$. . . 1.7%
$NH_3$. . . 3.3%.

* * * * *